US007588607B1

(12) United States Patent
Cap

(10) Patent No.: US 7,588,607 B1
(45) Date of Patent: Sep. 15, 2009

(54) CANDLEWAX COMPOSITIONS WITH IMPROVED SCENT-THROW

(75) Inventor: Daniel S. Cap, 114 Jill La., Streamwood, IL (US) 60107

(73) Assignee: Daniel S. Cap, Maryville, TN (US)

( * ) Notice: Subject to any disclaimer, the term of this patent is extended or adjusted under 35 U.S.C. 154(b) by 825 days.

(21) Appl. No.: 11/081,917

(22) Filed: Mar. 16, 2005

(51) Int. Cl.
*C11C 5/00* (2006.01)
*C10L 5/00* (2006.01)

(52) U.S. Cl. ..... 44/275; 431/288

(58) Field of Classification Search ..... 424/184; 524/80; 44/275
See application file for complete search history.

(56) References Cited

U.S. PATENT DOCUMENTS

| | | | | |
|---|---|---|---|---|
| 1,935,946 | A | 11/1933 | Egan et al. | |
| 1,954,659 | A | 4/1934 | Will | |
| 1,958,462 | A | 5/1934 | Baumer | |
| 3,630,697 | A | 12/1971 | Duling et al. | |
| 3,645,705 | A | 2/1972 | Miller et al. | |
| 3,744,956 | A | 7/1973 | Hess | |
| 3,844,706 | A | 10/1974 | Tsaras | |
| 4,118,203 | A | 10/1978 | Beardmore et al. | |
| 4,134,718 | A | 1/1979 | Kayfetz et al. | |
| 4,293,345 | A | 10/1981 | Zeilstra et al. | |
| 4,314,915 | A | 2/1982 | Wiegers et al. | |
| 4,390,590 | A | 6/1983 | Saunders et al. | |
| 4,411,829 | A | 10/1983 | Schulte-Elte et al. | |
| 4,434,306 | A | 2/1984 | Kobayashi et al. | |
| 4,507,077 | A | 3/1985 | Sapper | |
| 4,567,548 | A | 1/1986 | Schneeberger | |
| 4,608,011 | A | 8/1986 | Comstock | |
| 4,614,625 | A | 9/1986 | Wilson | |
| 4,714,496 | A | 12/1987 | Luken, Jr. et al. | |
| 4,759,709 | A | 7/1988 | Luken, Jr. et al. | |
| 4,813,975 | A | 3/1989 | Poulina et al. | |
| 4,842,648 | A | 6/1989 | Phadoemchit et al. | |
| 4,855,098 | A | 8/1989 | Taylor | |
| 5,171,329 | A | 12/1992 | Lin | |
| 5,338,187 | A | 8/1994 | Elharar | |
| 5,401,500 | A * | 3/1995 | Warren et al. | 424/84 |
| 5,578,089 | A | 11/1996 | Elsamaloty | |
| 5,753,015 | A | 5/1998 | Sinwald et al. | |
| 5,843,194 | A | 12/1998 | Spaulding | |
| 5,885,600 | A | 3/1999 | Blum et al. | |
| 6,007,286 | A | 12/1999 | Toyota et al. | |
| 6,019,804 | A | 2/2000 | Requejo et al. | |
| 6,022,402 | A | 2/2000 | Stephenson et al. | |
| 6,063,144 | A | 5/2000 | Calzada et al. | |
| 6,099,877 | A | 8/2000 | Schuppan | |
| 6,106,597 | A | 8/2000 | Starks et al. | |
| 6,132,742 | A | 10/2000 | Le Bras et al. | |
| 6,156,369 | A | 12/2000 | Eger et al. | |
| 6,214,918 | B1 | 4/2001 | Johnson et al. | |
| 6,276,925 | B1 | 8/2001 | Varga | |
| 6,277,310 | B1 | 8/2001 | Sleeter | |
| 6,284,007 | B1 | 9/2001 | Tao | |
| 6,395,701 | B1 * | 5/2002 | Connor et al. | 510/437 |
| 6,497,735 | B2 | 12/2002 | Tao | |
| 6,503,285 | B1 * | 1/2003 | Murphy | 44/275 |
| 6,599,334 | B1 | 7/2003 | Anderson | |
| 6,645,261 | B2 | 11/2003 | Murphy et al. | |
| 6,758,869 | B2 | 7/2004 | Roeske et al. | |
| 6,773,469 | B2 | 8/2004 | Murphy | |
| 6,797,020 | B2 | 9/2004 | Murphy | |
| 2002/0005007 | A1 | 1/2002 | Roeske et al. | |
| 2002/0055562 | A1 * | 5/2002 | Butuc | 524/80 |
| 2002/0157303 | A1 * | 10/2002 | Murphy et al. | 44/275 |
| 2003/0009929 | A1 * | 1/2003 | Newton et al. | 44/275 |
| 2003/0022121 | A1 | 1/2003 | Biggs | |
| 2003/0046860 | A1 | 3/2003 | Tiffany et al. | |
| 2003/0061760 | A1 | 4/2003 | Tao et al. | |
| 2003/0091949 | A1 | 5/2003 | Pesu et al. | |
| 2003/0110683 | A1 | 6/2003 | Murphy | |
| 2004/0031191 | A1 | 2/2004 | D'Amico et al. | |
| 2004/0088907 | A1 | 5/2004 | Murphy | |
| 2004/0088908 | A1 | 5/2004 | Murphy | |
| 2004/0221503 | A1 * | 11/2004 | Murphy et al. | 44/275 |

FOREIGN PATENT DOCUMENTS

| | | |
|---|---|---|
| EP | 0 685 554 | 12/1995 |
| JP | 4-59897 | 2/1992 |
| JP | 6-9987 | 1/1994 |
| WO | WO 96/14373 | 5/1996 |

(Continued)

OTHER PUBLICATIONS

D.J.Undersander, Alternative Field Crops Manual, "JoJoba", Dept of Agronomy, College of Agricultural and Life Sciences and Cooperative Extension Service, University of Wisconsin-Madison, WI 53706. Oct. 1990.*

(Continued)

*Primary Examiner*—Ellen M McAvoy
*Assistant Examiner*—Chantel Ferguson-Graham
(74) *Attorney, Agent, or Firm*—Pauley Petersen & Erickson

(57) ABSTRACT

A candlewax composition having improved scent-throw, and candles made from the composition, are provided. The candlewax composition includes at least a wax component and an antifoam agent. An effective amount of a scenting agent can be separately added by a candlemaker.

47 Claims, No Drawings

FOREIGN PATENT DOCUMENTS

| | | |
|---|---|---|
| WO | WO 02/092736 | 11/2002 |
| WO | WO 03/012016 | 2/2003 |

OTHER PUBLICATIONS

R.O. Feuge, et al., *Modification of Vegetable Oils, XII, Plasticity of Some Aceta Derivatives of Monostearin, The Journal of The American Oil Chemists' Society* (Jan. 1952 Issue, vol. XXIX, No. 1, pp. 11-14).

R.O. Feuge, et al., *Modification of Vegetable Oils, XIII*, Some Additional Properties of Acetostearin, *Products, The Journal of The American Oil Chemists' Society* (Jul. 1953 Issue, vol. XXX, No. 7, pp. 283-287).

Audrey T. Gros, et al., *Consistency of Fats Plasticized with Acetoglycerides, The Journal of The American Oil Chemists' Society*, (Sep. 1954 Issue, vol. XXXI, No. 9, pp. 377-383.

*The Present Status of Acetoglycerides*, by Alfin-Slater, et al., *The Journal of The American Oil Chemists' Society*, (Mar. 1958 Issue, vol. XXXV, No. 3, pp. 122-127.

*Bibliography On Acetoglycerides*, Southern Utilization Research and Development Division (Feb. 1961).

*The Candlelighter, International Guild of Candle Artisans*, excerpts from issues dated Oct. 1999 (pp. 5871, 5883,5889). Nov. 1999 (p. 5957), Dec. 1999 (p. 6008), Feb. 2000 (p. 6153), Apr. 2000 (p. 6247), May 2000 (Advertisement for Ecowax™ CB), Jun. 2000 (p. 6299), Aug. 2000 (p. 6408).

International Guild of Candle Artisans Yearbook and Buyers' Guide (Jan. 2000) (cover page and pp. 6081-6082).

Archer Daniels Midland Company technical data sheets (5 pages) for DMG-40 and Panalite 90-DK Distilled Monoglycerides.

*DPI's Acetoglycerides on Way, Chemical And Engineering News* (two sheets of p. 1298).

*Low shrinkage container wax mixtures using vegetable oils*, http://web.nstar.net/~vvhpbc/temp/candveg.htm (9 pages).

*Animal and Vegetable Fixed Oils, Fats, Butters, and Waxes, Their Preparation and Properties*, by C.R. Wright, (2d Ed., 1903) (pp. 624-669).

*The Industrial Chemistry of the Fats and Waxes*, by T.P. Hilditch et al., D. Van Nostrand Company (1927) (pp. 338-351).

*The Fats And Oils: A General View*, by Carl Alsberg et al., Fats And Oils Studies (Feb. 1928), Food Research Institute, (pp. 1-41).

*Industrial Waxes—Natural and Synthetic Waxes* (vol. I), by H. Bennett, Chemical Publishing Company, Inc. (1963) (pp. 131-155).

*Industrial Waxes—Compounded Waxes and Technology* (vol. II), by H. Bennett, Chemical Publishing Company, Inc. (1963) (three sheets including pp. 206-207).

*Bailey's Industrial Oil And Fat Products* (vol. 2, 4th Ed.), by Robert Allen, et al., (Copyright 1982, John Wiley & Sons, Inc.) (excerpts).

*The Merck Index* (9th Ed.), Merck & Co., Inc. (1976) (pp. 1251-1252).

*Candle Making*, by Terence McLaughlin, Coles Publishing Company Limited (1977), (3 sheets, including pp. 18-19).

*Candle Crafting From an Art to a Science*, by W. Nussle, A.S. Barnes and Co., Inc. (1971) (pp. 13-20 and 30-32).

*The soybean wax advantage*, Soyawax Soybean Wax—and Candleworks:—The Candle People (web page excerpt consisting of 5 pages), Victor Communications Company, LLC., (2001).

*The soybean wax advantage*, Soyawax Soybean Wax—and Candleworks:—The Candle People (web page excerpt, consisting of 5 pages, including company and products profile), Victor Communications Company, LLC. (2001).

Press Release, (two pages) (Mar. 4, 2003).

*Soy Candle History*, five-page excerpt from web site www.thesoydailyclub.com (Aug. 6, 2004).

Two-page article excerpt regarding history of Soyawax (undated).

Institute of Shortening of Edible Oils, Inc., *Food Fats & Oils*, (2nd Edition), 1999.

* cited by examiner

CANDLEWAX COMPOSITIONS WITH IMPROVED SCENT-THROW

FIELD OF THE INVENTION

This invention is directed to candlewax compositions having improved scent-throw compared to previous compositions.

BACKGROUND OF THE INVENTION

Many candlewax compositions are combined with scenting agents designed to emit scent, before and during burning of candles. The scenting agents provide pleasant aromas which render the candles more appealing to consumers. The scenting agents typically provide stronger aromas during burning of the candles, in order to fragrance the surrounding environment.

A variety of scenting agents and amounts can be added to candlewax to achieve desired aromas. However, the amount of scent emitted has often been hindered because the scenting agents become chemically or physically affiliated with other candlewax ingredients. The scenting agents can become somewhat "locked up" within the candlewax, so that their aroma potential is not fully realized. There is a need or desire for candlewax compositions which facilitate the release of greater amounts of aroma based on the amount of scenting agent employed.

SUMMARY OF THE INVENTION

The present invention is directed to candlewax compositions having improved scent-throw due to the use of additives which influence the surface tension of molten candlewax so that the aromas escape more easily. Suitable additives are those which are known in the paint, ink and coating industries as antifoam agents. Antifoam agents have not conventionally been used in candlewax compositions, and were not previously known to improve the release of aromas from candlewax compositions.

In one embodiment, the candlewax composition of the invention includes:

a) a plant-based wax, and b) an antifoam agent.

In another embodiment, the candlewax composition of the invention may include:

a) a paraffin-based wax, and b) an antifoam agent.

In another embodiment, the candlewax composition of the invention may include:

a) a plant-based wax, b) a paraffin-based wax, and c) an antifoam agent.

In most instances, the scenting agent will be separately added by the candlemaker after the candlewax composition has been manufactured and sold. Therefore, the present invention is also directed to any of the foregoing candlewax compositions, further including an effective amount of a scenting agent.

The present invention is also directed to candlewax compositions which are particularly responsive to the use of antifoam agents for the purpose of improving scent-throw. In one embodiment, a candlewax composition particularly suitable for use in combination with an antifoam agent may include:

a) about 50-90% by weight of a partially hydrogenated or fractionated vegetable oil, b) about 10-40% by weight of one or more propylene glycol monoesters, and c) zero to about 20% by weight of a free fatty acid.

In this embodiment, an antifoam agent and scenting agent may later be added. The foregoing and other embodiments are described in greater detail below.

DEFINITIONS

As used herein, the term "plant-based wax" refers to a plant-based substance which has a solid, wax-like consistency at ambient conditions (72° F., 50% relative humidity). The term includes vegetable oils which have been partially or fully hydrogenated or fractionated to generate a solid, wax-like consistency, and plant-based substances such as carnauba wax and candelilla wax which have a solid, wax-like consistency without requiring hydrogenation.

As used herein, the term "paraffin-based wax" refers to waxes derived from a class of all aliphatic hydrocarbons characterized by a straight or branched hydrocarbon chain, having a molecular formula $C_nH_{2n+2}$, and a high enough molecular weight to produce a melting point of about 40-65° C. Paraffin waxes also have a solid, wax-like consistency at ambient conditions (22° C., 50% relative humidity). Paraffin waxes typically include a mixture of high molecular weight aliphatic hydrocarbons, which mixture possesses these properties.

As used herein, "hydrogenated vegetable oil" encompasses partially and fully hydrogenated vegetable oils.

As used herein, "vegetable oil" includes any plant-based oil. Vegetable oils may be naturally occurring or processed, and may be solid or liquid at ambient conditions (22° C., 50% relative humidity). The term includes plant-based oils whose fatty acids are unsaturated, partially or fully saturated.

As used herein, "partially hydrogenated vegetable oil" includes any plant-based oil which has been partially hydrogenated. The term "partially hydrogenated vegetable oil" also includes mixtures of partially hydrogenated vegetable oil and fully hydrogenated vegetable oil. Such mixtures are by definition, partially hydrogenated with an intermediate level of hydrogenation. Similarly, the term "partially hydrogenated vegetable oil" includes mixtures of partially hydrogenated vegetable oil and vegetable oil which has not been hydrogenated, and mixtures of fully hydrogenated and unhydrogenated vegetable oil.

As used herein, "fully hydrogenated vegetable oil" includes any plant-based oil which has been fully hydrogenated. Fully hydrogenated vegetable oils typically have iodine values between zero and five.

As used herein, "iodine value" is the number of grams of iodine that an unsaturated compound or blend will absorb in a given time under arbitrary conditions. A low iodine value implies a high level of saturation, and vice versa. The iodine value can be determined by the WIJS method of the American Oil Chemists' Society (A.O.C.S. Cd 1-25).

As used herein, the term "antifoam agent" refers to any substance useful to reduce foaming of paints, inks, lipids and coatings due to proteins, gases or nitrogeneous materials which may interfere with processing. Antifoam agents are believed to reduce the surface tension of molten candlewax, thus facilitating a more efficient release of aromas. Antifoam agents include without limitation 2-octanol, sulfonated oils, organic phosphates, silicone fluorides, and dimethyl polysiloxane.

As used herein, the term "scenting agent" refers to any additive for a candlewax composition which is intended to release a selected aroma prior to or during burning of a candle made from the candlewax composition. Examples of scenting agents include without limitation scented oils, essential oils and other liquid fragrances.

DETAILED DESCRIPTION OF THE INVENTION

The present invention is directed to a candlewax composition including an antifoam agent for improved scent-throw. In one embodiment, the candlewax composition is a plant-based wax composition which includes a plant-based wax and an antifoam agent. A scenting agent may be separately added as explained above. The plant-based wax can include any plant-based substance which has a solid, wax-like consistency at ambient conditions.

Examples of plant-based waxes include plant-based substances such as carnauba wax, candelilla wax and rice bran wax which have a wax-like consistency without requiring hydrogenation. Examples also include palm wax, cocoa butter, coconut oil, and all oils having a naturally high degree of saturation. Other examples include partially and fully hydrogenated vegetable oils (collectively "hydrogenated vegetable oils") having an iodine value of about 0-100, suitably about 10-90, particularly about 15-80 and desirably about 20-75. A fully-hydrogenated vegetable oil may have an iodine value of about 0-5. Generally, the melting point of a vegetable oil increases as the level of hydrogenation increases and the iodine value decreases. The hydrogenation process adds hydrogen atoms to the carbon-carbon double bonds in unsaturated fatty acids. In addition to higher melting points, hydrogenation leads to higher solid fat content and longer shelf life. Partially hydrogenated vegetable oils typically have a higher iodine value, and are useful in applications (e.g., container candles) where lower melting points are desired.

The plant-based wax can also be a fractionated vegetable oil. Fractionation removes the solid, wax-like components from the liquid components of vegetable oil by controlled crystallization and separation. Fractionation techniques involve the use of solvents or dry processing. The effect of hydrogenation or fractionation is to provide a vegetable oil with a sufficiently high degree of saturation to perform as a wax having a desired melting point and other properties.

The hydrogenated or fractionated vegetable oil can be derived from any plant-based oil. Examples include without limitation cottonseed oil, sunflower oil, canola oil, peanut oil, soybean oil, safflower oil, corn oil, palm oil, olive oil, coconut oil, palm kernel oil, almond oil, jojoba oil, avocado oil, sesame oil, castor oil, and combinations thereof. The hydrogenated or fractionated vegetable oil may be derived from one or more vegetable oils having the same or different levels of saturation. Vegetable oils derived from natural sources typically include one or more triglycerides as a major component, lesser amounts of diglycerides and monoglycerides, and very minor amounts of free fatty acids. A triglyceride is an ester compound of glycerol linked to three fatty acids, and has the following general formula:

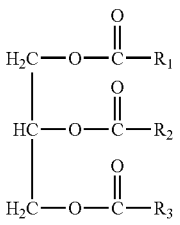

wherein $R_1$, $R_2$ and $R_3$ are fatty acid chains and may be the same or different.

A diglyceride is an ester compound of glycerol linked to two fatty acid chains. A monoglyceride is an ester composed of glycerol linked to one fatty acid chain. A free fatty acid is an unattached fatty acid in a vegetable oil, most commonly stearic acid and/or palmitic acid.

The hydrogenated vegetable oil can be partially or fully hydrogenated using known techniques for chemically adding hydrogen gas to a liquid vegetable oil in the presence of a catalyst. The process converts some or all of the unsaturated carbon-carbon double bonds in the vegetable oil molecules to single carbon-carbon bonds, thereby increasing the level of saturation. The degree of hydrogenation reflects the total number of double bonds which are converted. The hydrogenation may cause partial or total saturation of the double bonds in any of the vegetable oil components, including triglycerides, diglycerides, monoglycerides and free fatty acids. Partial hydrogenation may relocate some of the double bonds to new locations, e.g., from a cis isomeric configuration to a trans isomeric configuration. Sufficient hydrogenation typically causes the vegetable oil to assume a solid or semi-solid state at ambient temperature (e.g., 22° C.).

The plant-based wax composition may contain at least about 40% plant-based wax, suitably about 51-99% by weight, or about 60-95% by weight, or about 70-90% by weight, or about 60-80% by weight.

The plant-based wax composition also includes an antifoam agent. Antifoam agents include without limitation 2-octanol, sulfonated oils, organic phosphites, glyceryl oleate, glyceryl soyate, silicone fluorides, dimethyl polysiloxane, and other silicone compounds. Silicone antifoam agents based on polydimethyl siloxane are available from New London Chemicals of Inverness, Ill., under the trade names C-2005, C-2010, C-2020, C-2030, C-2100 and C-21030. Non-silicone antifoam agents are also available from New London Chemicals. Other silicone-based antifoam agents are available from Wacker Chemical Corp. of Adrian, Mich. under the trade name AK FLUIDS US, and from Noveon Co. under the trade name FOAM BLAST®, PLURONIC® block copolymers, available from BASF Corp., are also suitable for use as antifoam agents.

The antifoam agent may be present in an amount of about 1-500 parts per million (ppm), suitably about 2-100 ppm, or about 3-50 ppm, or about 5-15 ppm. If the amount of antifoam agent is either too low or too high, the improvement in scent-throw resulting from the antifoam agent will not be optimized. The antifoam agent may provide other advantages, such as reduction or elimination of undesirable crystal growth or oil migration known as "frosting." Frosting may occur when the candlewax is cooled from a molten state to a solid state, or more slowly over time. Frosting may also appear due to changes in environmental conditions.

The plant-based wax compositions may also contain one or more polyol fatty acid partial ester components. Polyols which can be used to form the fatty acid partial esters include at least two and, preferably, at least three hydroxy groups per molecule (also referred to as "polyhydric alcohols"). Typically, the polyols have no more than 6 hydroxy groups per molecule and include up to 10 carbon atoms and more commonly no more than 6 carbon atoms. Examples of suitable aliphatic polyols include glycerol, alkylene glycols (e.g., ethylene glycol, diethylene glycol, triethylene glycol and neopentylglycol), pentaerythritol, trimethylolethane, trimethylolpropane, sorbitan and sorbitol. Suitable alicyclic polyols include cyclohexanediols and inositol as well as natural cyclic polyols such as glucose, galactose and sorbose.

The polyol partial esters have one or more unesterified hydroxyl groups with the remaining hydroxy groups esterified by a fatty acyl group. The fatty acyl groups ("—C(O)R") in the partial esters include an aliphatic chain (linear or branched) and typically have from 14 to 30 carbon atoms.

Fatty acid partial esters of polyols which include no more than about 6 carbon atoms and have three to six hydroxy groups per molecule, such as glycerol, pentaerythritol, trimethylolethane, trimethylolpropane, sorbitol, sorbitan, inositol, glucose, galactose, and/or sorbose, are suitable. Glycerol and/or sorbitan partial esters are examples of polyol partial esters.

Fatty acid monoesters of polyols are suitable for use. Suitable examples include glycerol monoesters, e.g., glycerol monostearate, glycerol monopalmitate, and/or glycerol monooleate, and/or sorbitan monoesters, e.g., sorbitan monostearate, sorbitan monopalmitate, and/or sorbitan monooleate. Monoesters which are produced by partial esterification of a polyol with a mixture of fatty acids derived from hydrolysis of a triacylglycerol stock are also suitable. Examples include monoglycerol esters of a mixture of fatty acids derived from hydrdolysis of a partially or fully hydrogenated vegetable oil, e.g., fatty acids derived from hydrolysis of fully hydrogenated soybean oil.

Propylene glycol monoesters are particularly suitable for use in plant-based wax compositions according to the invention. Monoglycerides and diglycerides are also suitable. Other examples of suitable polyol fatty acid partial esters include without limitation di- and/or triesters of higher polyols, e.g., di- and/or triesters of a polyol having 5 hydroxy groups, such as sorbitan. For example, the plant-based wax composition may include one or more sorbitan triesters of fatty acids having 16 to 18 carbon atoms, e.g., sorbitan tristearate, sorbitan tripalmitate, sorbitan trioleate, and mixtures including one or more of these triesters.

When used, the polyol fatty acid partial acid ester component may constitute about 1-45% by weight of the plant-based candlewax composition, suitably about 5-40% by weight, or about 15-35% by weight, or about 20-30% by weight.

The plant-based candlewax composition may also include one or more free fatty acids. Examples of free fatty acids include without limitation lauric acid, myristic acid, palmitic acid, stearic acid, arachidic acid, palmitoleic acid, oleic acid, gadoleic acid, linoleic acid, linolenic acid and combinations thereof. When used, the free fatty acid component may constitute about 1-40% by weight of the plant-based candlewax composition, suitably about 3-25% by weight, or about 5-10% by weight.

The plant-based wax composition may also include other optimal wax ingredients, including without limitation, beeswax, montan wax, paraffin wax, and other conventional waxes. When used, these other wax ingredients typically do not constitute more than about 25% of the plant-based wax composition. Conventional dyes, pigments and other coloring agents may be added at up to about 3% by weight, suitably about 0.1-1.5% by weight.

The plant-based wax composition may be composed of ingredients selected to provide a melting point of about 35-65° C., suitably about 40-55° C. The ingredients of the wax composition can be added individually or together to a melt blender and mixed at about 50-95° C., suitably about 55-70° C. until a uniform wax composition is obtained. Any conventional mixing equipment can be employed. The resulting plant-based wax composition is useful in a variety of candles.

The plant-based wax composition is suitable for addition of a scenting agent in an amount of about 0.1-15% by weight, suitably about 1-10% by weight, or about 2-6% by weight. Examples of scenting agents include without limitation scented oils such as sandalwood oil, civet oil, cedarwood oil, patchouli oil, bergamot oil, germanium oil, rose oil, citronella oil, and the like. Other liquid scenting agents include without limitation eugenol, geraniol, geranyl acetate, isoeugenol, isobornyl acetate, linalyl acetate, linalool, methyl ethyl ketone, methylionone, phenylethyl alcohol, and various other compounds of aldehydes, ketones, esters, alcohols, terpenes or the like. The scenting agent may be an insect repellent such as citronellal or a therapeutic agent such as menthol or eucalyptus.

In another embodiment, the candlewax composition is a paraffin-based wax composition including a paraffin wax and an antifoam agent. The paraffin-based wax composition may include at least 40% by weight paraffin wax, suitably about 51-99% by weight, or about 60-98% by weight, or about 70-95% by weight. The paraffin wax may suitably have an average carbon number of about 18 to about 40, suitably about 22 to about 36.

The paraffin-based wax composition also includes an antifoam agent, suitably in an amount of about 1-500 ppm, or about 2-100 ppm, or about 3-50 ppm, or about 5-15 ppm. Examples of suitable antifoam agents include without limitation any of the antifoam agents listed above as useful for plant-based wax compositions.

The paraffin-based wax composition may also contain a predominantly saturated fatty acid or fatty acid mixture. The fatty acid mixture may, for example, be composed predominantly of saturated fatty acids having 16 and 18 carbon atoms, and an alpha-alkyl-branched carboxylic acid obtained by the free radical addition of a $C_{20-44}$ alpha-olefin or alpha-olefin mixture with a $C_{3-36}$ carboxylic acid or carboxylic acid mixture. Such fatty acid mixtures are described in U.S. Pat. Nos. 4,714,496 and 4,759,709, both issued to Luken, Jr., the disclosures being incorporated herein by reference. When used, the predominantly saturated fatty acid or fatty acid mixture may constitute about 1-55% by weight of the paraffin-based wax composition, suitably about 3-45% by weight, or about 5-35% by weight, or about 7-25% by weight.

The paraffin-based wax composition may also include a polyol fatty acid partial ester component in an amount of about 1-45% by weight, or about 3-35% by weight, or about 5-25% by weight. Suitable polyol fatty acid partial ester components include those described above as being useful in a plant-based wax composition.

The paraffin-based wax composition may also contain other optional wax ingredients in amounts up to about 25% by weight. Conventional dyes, pigments and other coloring agents may be included at up to about 3% by weight, suitably about 0.1-1.5% by weight. The overall ingredients may be selected to provide a paraffin-based wax composition having a melting point of about 40-65° C., suitably about 50-60° C. The ingredients of the wax composition can be added individually or together to a conventional melt blender and mixed at about 50-95° C., suitably about 55-70° C. until a uniform wax composition is obtained.

The paraffin-based wax composition is suitable for addition of a scenting agent in an amount of about 0.1-15% by weight, suitably about 1-10% by weight, or about 2-6% by weight. Examples of suitable scenting agents include without limitation any of the scenting agents listed above as useful for plant-based wax compositions.

In another embodiment, the wax composition of the invention may include a combination of a plant-based wax composition and a paraffin-based wax composition. The components may be combined in any suitable ratio to provide a wax composition having desired properties.

The present invention is also directed to a candlewax composition that has been found particularly suitable for use with antifoam agents for the purpose of improving scent-throw. In one embodiment, the wax composition includes a partially hydrogenated or fractionated vegetable oil, one or more propylene glycol monoesters, and an optional free fatty acid. An antifoam agent may be added to the wax composition for improved scent-throw. A scenting agent may later be added, during candlemaking, as explained above.

The partially hydrogenated or fractionated vegetable oil may have an iodine value of about 30 to about 75, suitably about 45 to about 60. The vegetable oil may be selected from cottonseed oil, sunflower oil, canola oil, peanut oil, soybean oil, safflower oil, corn oil, palm oil, olive oil, coconut oil, palm kernel oil, almond oil, jojoba oil, avocado oil, sesame oil, castor oil, and combinations thereof. The partially hydrogenated or fractionated vegetable oil may be derived from one or more vegetable oils having the same or different levels of saturation. The partially hydrogenated or fractionated vegetable oil may constitute about 50-90% by weight of the wax composition, or about 60-80% by weight, or about 65-75% by weight. This component may have a melting point of about 40-55° C.

The propylene glycol monoester component may have an iodine value less than about 15, suitably less than about 10, or less than about 5. This component may constitute about 10-40% by weight of the candlewax composition, suitably about 15-35% by weight, or about 20-30% by weight. This component may have a melting point of about 40-55° C.

The free fatty acid may be selected from lauric acid, myristic acid, palmitic acid, stearic acid, arachidic acid, palmitoleic acid, oleic acid, gadoleic acid, linoleic acid, linolenic acid and combinations thereof. The free fatty acid may constitute about 0-20% by weight of the wax composition, suitably about 1-15% by weight, or about 2-8% by weight. The free fatty acid may have an iodine value less than about 15, or less than about 10, or less than about 5.

The candlewax composition can also contain monoglycerides and/or diglycerides in a combined amount of about 0-15% by weight, suitably about 0.5-10% by weight, or about 1-5% by weight. Other conventional ingredients may optionally be included.

The foregoing ingredients may be combined to provide a candlewax composition particularly suitably for use with an antifoam agent. The antifoam agent may be selected from one or more antifoam agents listed above, and may be added at about 1-500 ppm, or about 2-100 ppm, or about 3-50 ppm, or about 5-15 ppm. The candlewax composition may have an overall iodine value of about 20 to about 65, suitably about 35 to about 45, and may have an overall melting point of about 35-50° C., suitably about 40-45° C.

The ingredients of the plant-based wax composition particularly suitable for use with an antifoam agent can be selected so that the fatty acid composition of the overall wax composition falls within desired ranges. The fatty acid composition represents a percentage breakdown of different fatty acids in the wax composition, based on 100% of the fatty acids present. The fatty acid composition of the wax composition may include about 5-25% by weight C18:1 fatty acids (not including trans fatty acids), about 20-40% by weight C18:1 trans fatty acids, about 30-50% by weight C18:0 fatty acids, and about 5-25% by weight C16:0 fatty acids. Suitably, the fatty acid composition of the candlewax composition may include about 10-20% by weight C18:1 fatty acids, about 25-35% by weight C18:1 trans fatty acids, about 35-45% by weight C18:0 fatty acids, and about 8-18% by weight C16:0 fatty acids. Other fatty acids may be present in lesser amounts, typically totaling less than about 5% by weight of the fatty acid composition.

The scenting agent to be added may be selected from any of the scenting agents listed above, and may include two or more scenting agents combined. The scenting agent may be added at about 0.1-15% by weight, suitably about 1-10% by weight, or about 2-6% by weight of the candlewax composition.

Any of the candlewax compositions of the invention can be combined with a wick and formed into a candle using conventional techniques. The candle wick may be a conventional string wick or a stringless wick. A candle can be formed by pouring candlewax into a mold equipped with a wick, forming a candle in the mold, and releasing it from the mold. A candle can alternatively be formed by pouring candlewax into a permanent candle container equipped with a wick, and forming the candle in the container. A candle can alternatively be formed by dipping a candle wick numerous times in a pool of molten candlewax, to gradually form the candle around the wick.

EXAMPLE 1

A control candlewax composition can be prepared by mixing together 180-210 grams of partially hydrogenated soybean oil having an iodine value of 53 and a melting point of 47° C., 60-90 grams of propylene glycol monoester having an iodine value of up to 5, 9-30 grams of stearic acid, and 15-30 grams of a fragrance oil scenting agent, at a temperature of 88° C. for a time of 10 minutes.

Another candlewax composition can be prepared having the same composition at the same conditions, except that 5-15 ppm of a polydimethyl siloxane antifoam agent can be added.

Identical candlewax compositions with and without the antifoam agent were formed into container candles each equipped with a wick. The candles were lit, and qualitatively evaluated for scent-throw by a panel of three persons. All three persons agreed that the candlewax made with the antifoam agent had a stronger scent than the candlewax made without the antifoam agent. The test was repeated for eight different scenting agents, yielding the same result in each case.

EXAMPLE 2

A control candlewax composition can be prepared by mixing together 205-235 grams of partially hydrogenated soybean oil having an iodine value of 53 and a melting point of 47° C., 50-80 grams of propylene glycol monoester having an iodine value of up to 5, 5-25 grams of stearic acid, 1-10 grams of a mixture of monoglycerides and diglycerides, and 15-30 grams of a fragrance oil scenting agent, at a temperature of 88° C. for a time of 10 minutes.

Another candlewax composition can be prepared having the same composition at the same conditions, except that 5-15 ppm of a polydimethylsiloxane antifoam agent can be added.

Identical candlewax compositions with and without the antifoam agent were formed into container candles each equipped with a wick and the candles were lit. Again, the candlewax compositions containing the antifoam agent had a stronger scent than identical compositions without the antifoam agent.

While the embodiments of the invention described herein are presently preferred, various modifications and improvements can be made without departing from the spirit and scope of the invention. The scope of the invention is indicated by the appended claims, and all changes that fall within the meaning and range of equivalents are intended to be embraced therein.

I claim:

1. A candlewax composition for use in a candle, comprising:

at least about 40% by weight of a wax selected from the group consisting of plant-based waxes, paraffin waxes, and combinations thereof; and about 1-500 ppm of an antifoam agent selected from the group consisting of 2-octanol, sulfonated oils, organic phosphites, glyceryl soyate, silicone compounds, and combinations thereof;

wherein the antifoam agent facilitates a more efficient release of aroma from the candlewax composition during burning of the candle.

2. The candlewax composition of claim 1, wherein the wax comprises a plant-based wax.

3. The candlewax composition of claim 1, wherein the wax comprises a paraffin-based wax.

4. The candlewax composition of claim 1, wherein the antifoam agent comprises polydimethyl siloxane.

5. The candlewax composition of claim 1, wherein the antifoam agent is present in an amount of about 3-50 ppm.

6. The candlewax composition of claim 1, wherein the antifoam agent is present in an amount of about 5-15 ppm.

7. The candlewax composition of claim 1, further comprising a scenting agent.

8. The candlewax composition of claim 7, wherein the scenting agent is selected from the group consisting of sandalwood oil, civet oil, cedarwood oil, patchouli oil, bergamot oil, germanium oil, rose oil, citronella oil, and combinations thereof.

9. The candlewax composition of claim 7, wherein the scenting agent is selected from the group consisting of eugenol, geraniol, geranyl acetate, isoeugenol, isobornyl acetate, linalyl acetate, linalool, methyl ethyl ketone, methylionone, phenyl ethyl alcohol, and combinations thereof.

10. The candlewax composition of claim 7, wherein the scenting agent comprises an insect repellent.

11. The candlewax composition of claim 7, wherein the scenting agent comprises a therapeutic agent.

12. A candle comprising a wick and the candlewax composition of claim 1.

13. A candlewax composition for use in a candle, comprising:

about 51-99% by weight of a plant-based wax; and about 1-500 ppm of an antifoam agent selected from the group consisting of 2-octanol, sulfonated oils, organic phosphites, glyceryl soyate, silicone compounds, and combinations thereof;

wherein the antifoam agent facilitates a more efficient release of aroma from the candlewax composition during burning of the candle.

14. The candlewax composition of claim 13, wherein the plant-based wax is selected from the group consisting of partially hydrogenated or fractionated cottonseed oil, sunflower oil, canola oil, peanut oil, soybean oil, safflower oil, corn oil, palm oil, olive oil, coconut oil, palm kernel oil, almond oil, jojoba oil, avocado oil, sesame oil, castor oil, and combinations thereof.

15. The candlewax composition of claim 13, wherein the plant-based wax is present at about 60-95% by weight.

16. The candlewax composition of claim 13, wherein the plant-based wax is present at about 70-90% by weight.

17. The candlewax composition of claim 13, wherein the plant-based wax is present at about 60-80% by weight.

18. The candlewax composition of claim 13, further comprising about 1-45% by weight of a polyol fatty acid partial ester component.

19. The candlewax composition of claim 18, wherein the polyol fatty acid partial ester component is selected from the group consisting of monoglycerides, diglycerides, and combinations thereof.

20. The candlewax composition of claim 18, wherein the polyol fatty acid partial ester component comprises a propylene glycol monoester.

21. The candlewax composition of claim 18, wherein the polyol fatty acid partial ester component is present at about 10-35% by weight.

22. The candlewax composition of claim 18, wherein the polyol fatty acid partial ester component is present at about 20-30% by weight.

23. The candlewax composition of claim 13, further comprising about 1-40% by weight of a free fatty acid selected from the group consisting of lauric acid, myristic acid, palmitic acid, stearic acid, arachidic acid, palmitoleic acid, oleic acid, gadoleic acid, linoleic acid, linolenic acid and combinations thereof.

24. The candlewax composition of claim 23, wherein the free fatty acid is present at about 3-25% by weight.

25. The candlewax composition of claim 13, wherein the antifoam agent comprises polydimethyl siloxane.

26. The candlewax composition of claim 13, further comprising about 0.01-15% by weight of a scenting agent.

27. A candle comprising a wick and the candlewax composition of claim 13.

28. A candlewax composition for use in a candle, comprising:

about 51-99% by weight of a paraffin wax; and about 1-500 ppm of an antifoam agent selected from the group consisting of 2-octanol, sulfonated oils, organic phosphites, glyceryl soyate, silicone compounds, and combinations thereof;

wherein the antifoam agent facilitates a more efficient release of aroma from the candlewax composition during burning of the candle.

29. The candlewax composition of claim 28, further comprising about 1-45% by weight of a predominantly saturated fatty acid or fatty acid mixture.

30. The candlewax composition of claim 29, wherein the predominantly saturated fatty acid or fatty acid mixture is present at about 5-35% by weight.

31. The candlewax composition of claim 28, wherein the antifoam agent comprises polydimethyl siloxane.

32. The candlewax composition of claim 28, further comprising about 0.1-15% by weight of a scenting agent.

33. A candle comprising a wick and the candlewax composition of claim 28.

34. A candlewax composition, for use in a candle, comprising:

about 50-90% by weight of a partially hydrogenated or fractionated vegetable oil;

about 10-40% by weight of a propylene glycol monoester;

zero to about 20% by weight of a free fatty acid; and about 1-500 ppm of an antifoam agent selected from the group consisting of 2-octanol, sulfonated oils, organic phosphate, glyceryl soyate, silicone compounds, and combinations thereof;

wherein the antifoam agent facilitates a more efficient release of aroma from the candlewax composition during burning of the candle.

35. The candlewax composition of claim 34, wherein the partially hydrogenated or fractionated vegetable oil has an iodine value of about 30-75.

36. The candlewax composition of claim 34, comprising about 60-80% by weight of the partially hydrogenated or fractionated vegetable oil.

37. The candlewax composition of claim 34, comprising about 15-35% by weight of the propylene glycol monoester.

38. The candlewax composition of claim 34, comprising about 2-8% by weight of the free fatty acid.

39. The candlewax composition of claim 34, wherein the antifoam agent comprises polydimethyl siloxane.

40. The candlewax composition of claim 34, further comprising about 0.5-10% by weight of a mixture of monoglycerides and diglycerides.

41. The candlewax composition of claim 34, having a fatty acid composition which includes about 5-25% by weight C18:1 fatty acids, about 20-40% by weight C18:1 trans fatty acids, about 30-50% by weight C18:0 fatty acids, and about 8-18% by weight C16:0 fatty acids.

42. The candlewax composition of claim 34, further comprising about 0.1-15% by weight of a scenting agent.

43. A candle comprising a wick and the candlewax composition of claim 34.

44. The candlewax composition of claim 1, wherein the antifoam agent is selected from the group consisting of 2-octanol, sulfonated oils, organic phosphates, silicone fluorides, dimethyl polysiloxane, and combinations thereof.

45. The candlewax composition of claim 13, wherein the antifoam agent is selected from the group consisting of 2-octanol, sulfonated oils, organic phosphates, silicone fluorides, dimethyl polysiloxane, and combinations thereof.

46. The candlewax composition of claim 28, wherein the antifoam agent is selected from the group consisting of 2-octanol, sulfonated oils, organic phosphates, silicone fluorides, dimethyl polysiloxane, and combinations thereof.

47. The candlewax composition of claim 34 wherein the antifoam agent is selected from the group consisting of 2-octanol, sulfonated oils, organic phosphates, silicone fluorides, dimethyl polysiloxane, and combinations thereof.

* * * * *